US005511945A

United States Patent [19]

Glezer et al.

[11] Patent Number: 5,511,945

[45] Date of Patent: Apr. 30, 1996

[54] TURBINE MOTOR AND BLADE INTERFACE COOLING SYSTEM

[75] Inventors: Boris Glezer, Del Mar; Aaron R. Fierstein; Russell B. Jones, both of San Diego, all of Calif.

[73] Assignee: Solar Turbines Incorporated, San Diego, Calif.

[21] Appl. No.: 331,403

[22] Filed: Oct. 31, 1994

[51] Int. Cl.[6] ..... F01D 5/30

[52] U.S. Cl. ..... 416/96 R; 416/219 R

[58] Field of Search ..... 416/95, 96 R, 416/97 R, 219 R, 220 R

[56] References Cited

U.S. PATENT DOCUMENTS 4,582,467 4/1986 Kisling ..... 416/95
5,403,156 4/1995 Arness et al. ..... 416/96 R

FOREIGN PATENT DOCUMENTS 1076446 2/1960 Germany ..... 416/95
1491480 11/1977 United Kingdom ..... 416/220 R

*Primary Examiner*—F. Daniel Lopez
*Assistant Examiner*—James A. Larson
*Attorney, Agent, or Firm*—Larry G. Cain

[57] ABSTRACT

Cooling air delivery systems for gas turbine engines are used to increase component life and increase power and efficiencies. The present system increases the component life and increases efficiencies by better utilizing the cooling air bled from the compressor section of the gas turbine engine. For example, a flow of cooling air which is directed through internal passages of the engine and into a cavity and is used to cool the interface between a turbine disc and a plurality of turbine blades and further reduces ingestion of hot power gases into the internal portion of the gas turbine engine. The cavity has a generally tapered configuration and effectively cools the interface between the disc and the blade. Thus, increasing component life and increasing power and efficiencies of the engine.

10 Claims, 6 Drawing Sheets

TURBINE MOTOR AND BLADE INTERFACE COOLING SYSTEM

TECHNICAL FIELD

This invention relates generally to gas turbine engine cooling and more particularly to the cooling of the interface between a turbine rotor and a turbine blade.

BACKGROUND ART

"The Government of the United States of America has rights in this invention pursuant to Contract No. DE-AC21-93-MC30246 awarded by the U.S. Department of Energy."

High performance gas turbine engines require cooling passages and cooling flows to ensure reliability and cycle life of individual components within the engine. For example, to improve fuel economy characteristics, engines are being operated at higher temperatures than the material physical property limits of which the engine components are constructed. These higher temperatures, if not compensated for, erode engine components and decrease component life. Cooling passages are used to direct a flow of coolant, such as air, to such engine components to reduce the high temperature of the components and prolong component life by limiting the temperature to a level which is consistent with material properties of such components.

Conventionally, a portion of the compressed air is bled from the engine compressor section to cool these components. Thus, the amount of air bled from the compressor section is usually limited to insure that the main portion of the air remains for engine combustion to perform useful work.

As the operating temperatures of engines are increased, to increase efficiency and power, either more cooling of critical components or better utilization of the cooling air is required.

Various arrangements for using cooling air to increase cycle life and reliability are available. U.S. Pat. No. 4,292,008 issued to William C. Grosjean et al on Sep. 29, 1981 discloses a cooling flow system. The system includes an air cooled turbine blade in which cooling air enters from a cavity through a passage to the root of the internally cooled rotor blades. A part of the cooling air is delivered through a longitudinally extending uniform passage in the disc intermediate the root of the blade and the disc. The narrow constant cross-section area of the space between the fir tree passage in the disc and the blade root is small and uniform and provides an extremely high local convective heat transfer coefficient through the passage. A uniform passage resulted in an increase in heat transfer associated with the high level of turbulence at the inlet but did not provide a uniform disc ring temperature along the axial length of the disc.

Another arrangement for using cooling air to increase cycle life and reliability is disclosed in U.S. Pat. No. 4,668,162 issued to Philip J. Cederwall et al on May 26, 1987. In this patent a cooling system includes a nozzle and shroud assembly having a plurality of through passages for transferring cooling air through the nozzle and a separate passage providing nozzle inner shroud cooling. From a reservoir below the nozzle a plurality of passages are provided for the cooling air to exit into an area below the turbine blades for buffering the hot main stream gas from reaching the rotor.

DISCLOSURE OF THE INVENTION

In one aspect of the present invention, a cooling air delivery system for cooling components of a gas turbine engine having a turbine assembly, a compressor section and a compressor discharge plenum fluidly connecting the air delivery system to the compressor section. The cooling delivery system is comprised of a means for providing a fluid flow path between the compressor section and the turbine assembly. The fluid flow path interconnects the compressor discharge plenum with the engine components to be cooled and has a cooling fluid flowing therethrough when the compressor section is in operation. The turbine assembly includes a disc having a first side, a second side, an outer periphery having a plurality of slots therein extending axially between the first side and the second side. A plurality of blades having a root portion positioned in corresponding ones of the plurality of slots are also included. The relationship of the slot to the root portion form a cavity having a generally tapered cross-section from the first side of the disc to the second side of the disc.

In another aspect of the invention, a turbine assembly including a disc having a first side, a second side, an outer periphery having a plurality of slots therein extending axially between the first side and the second side, and a plurality of blades having a root portion positioned in corresponding ones of the plurality of slots. And the relationship of the slot to the root portion forming a cavity having a generally tapered cross-section from the first side of the disc to the second side of the disc.

BEST MODE FOR CARRYING OUT THE INVENTION

Figure 1:
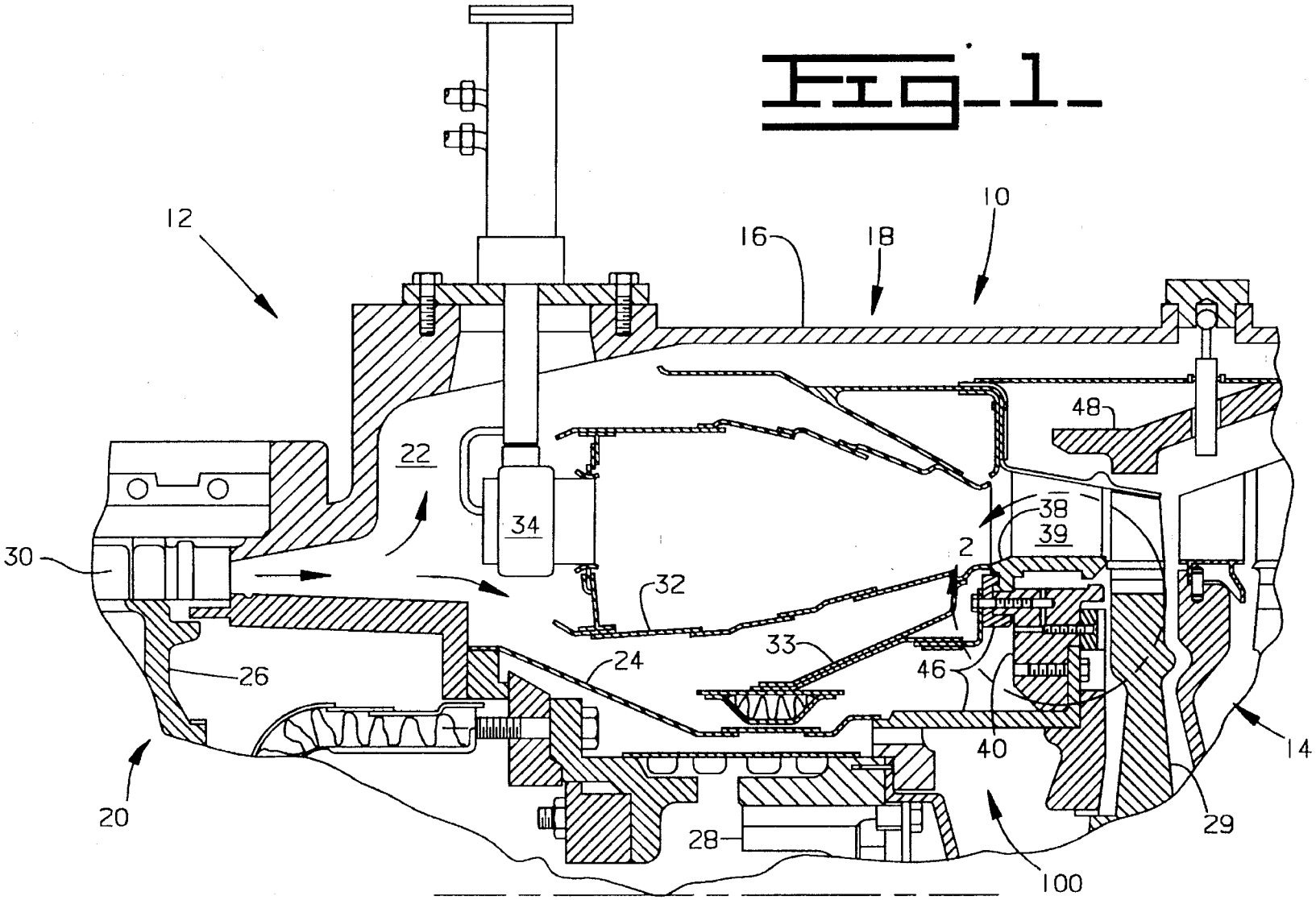
FIG. 1 is a sectional side view of a portion of a gas turbine engine embodying the present invention.

Referring to FIG. 1, a gas turbine engine 10, not shown in its entirety, has been sectioned to show a cooling air delivery system 12 for cooling components of a turbine section 14 of the engine. The engine 10 includes an outer case 16, a combustor section 18, a compressor section 20, and a compressor discharge plenum 22 fluidly connecting the air delivery system 12 to the combustor section 18. The plenum 22 is partially defined by the outer case 16 and a multipiece inner wall 24 partially surrounding the combustor section 18. The compressor section 20 includes a plurality of rotatable blades 26 attached to a longitudinally extending center shaft 28 driven by a gasifier turbine 29. A plurality of compressor stator blades 30 extend from the outer case 16 and are positioned axially between rotatable blades rows. The compressor section 20 is a multistage axial compressor although only a single stage is shown. The combustor section 18 includes an annular combustion chamber 32 supported within the plenum 22 by a plurality of supports 33, only one shown. A plurality of fuel nozzles 34 (one shown) are positioned in the plenum 22 at the end of the combustion chamber 32 near the compressor section 20. The turbine section 14 includes the gasifier turbine 29 disposed partially within an integral first stage nozzle and shroud assembly 38. The assembly 38 includes a plurality of individual nozzle and shroud members 39 and is supported from the center shaft 28 by a series of thermally varied masses 40 which are assembled to prevent rapid thermal growth during heating and cooling of such masses 40. The masses 40 are attached to a bearing housing arrangement 46. A nozzle support case 48 is disposed within the outer case 16 and attached to the case 16 by a plurality of bolts and dowels, not shown.

Figure 2:
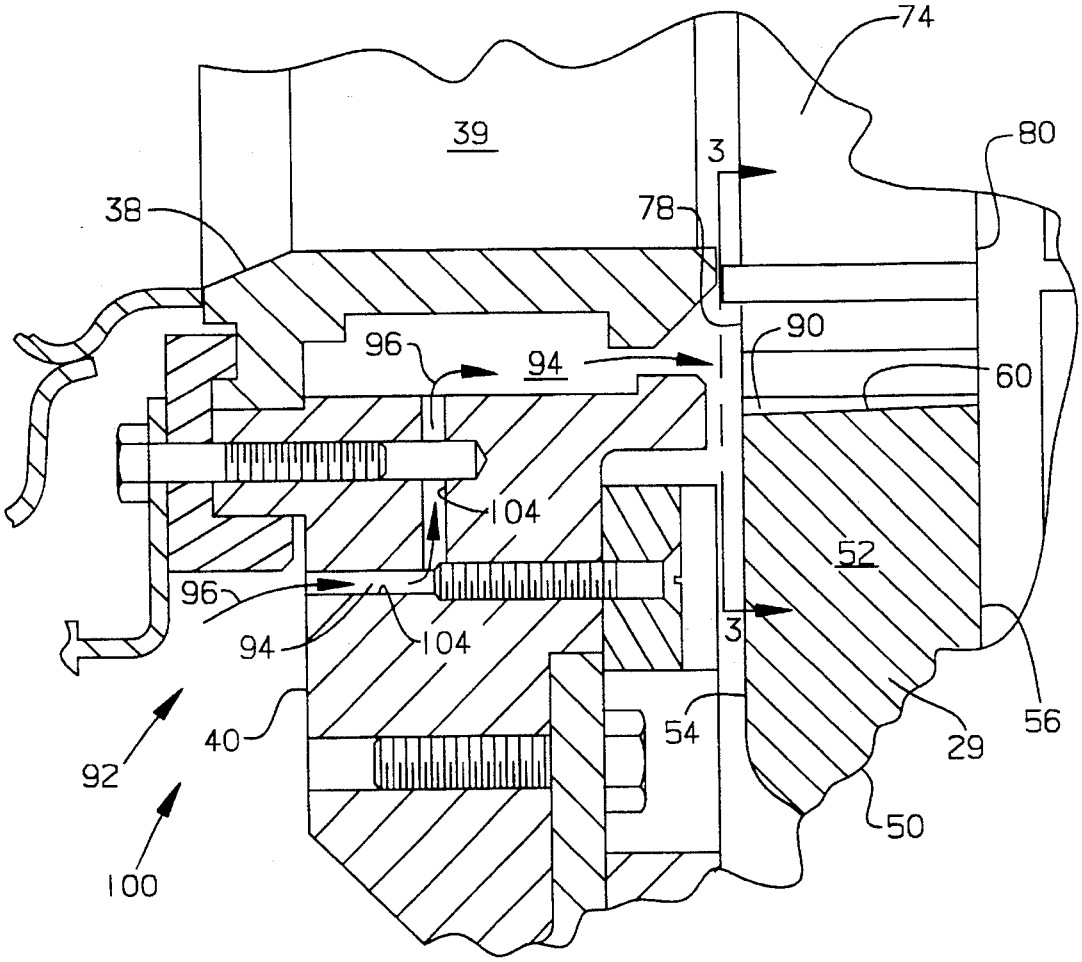
FIG. 2 is an enlarged sectional view of a portion of FIG. 1 embodying the present invention.
Figure 3:
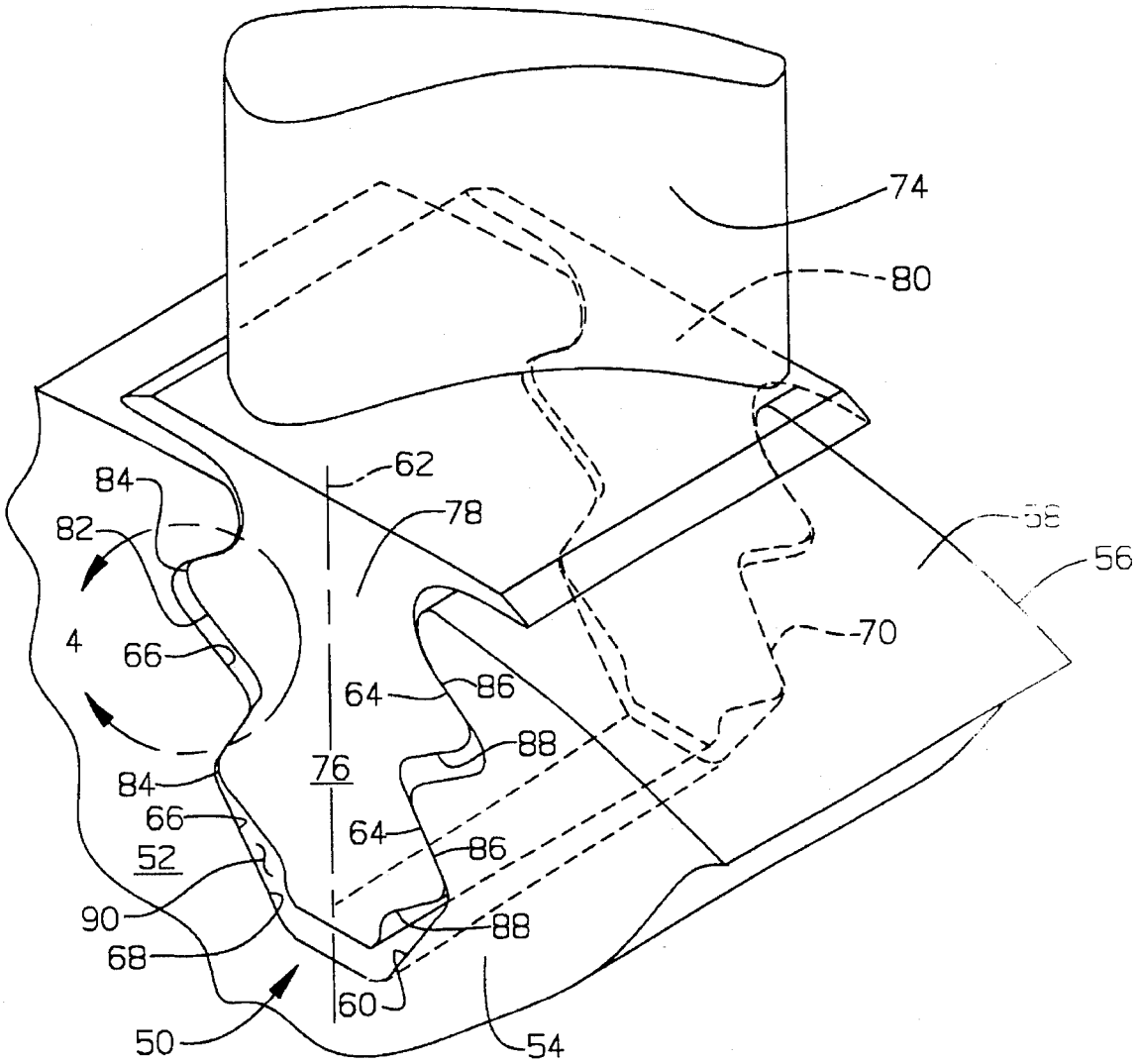
FIG. 3 is an enlarged pictorial view taken through a portion of a turbine rotor assembly along lines 3—3 of FIG. 2.
Figure 4:
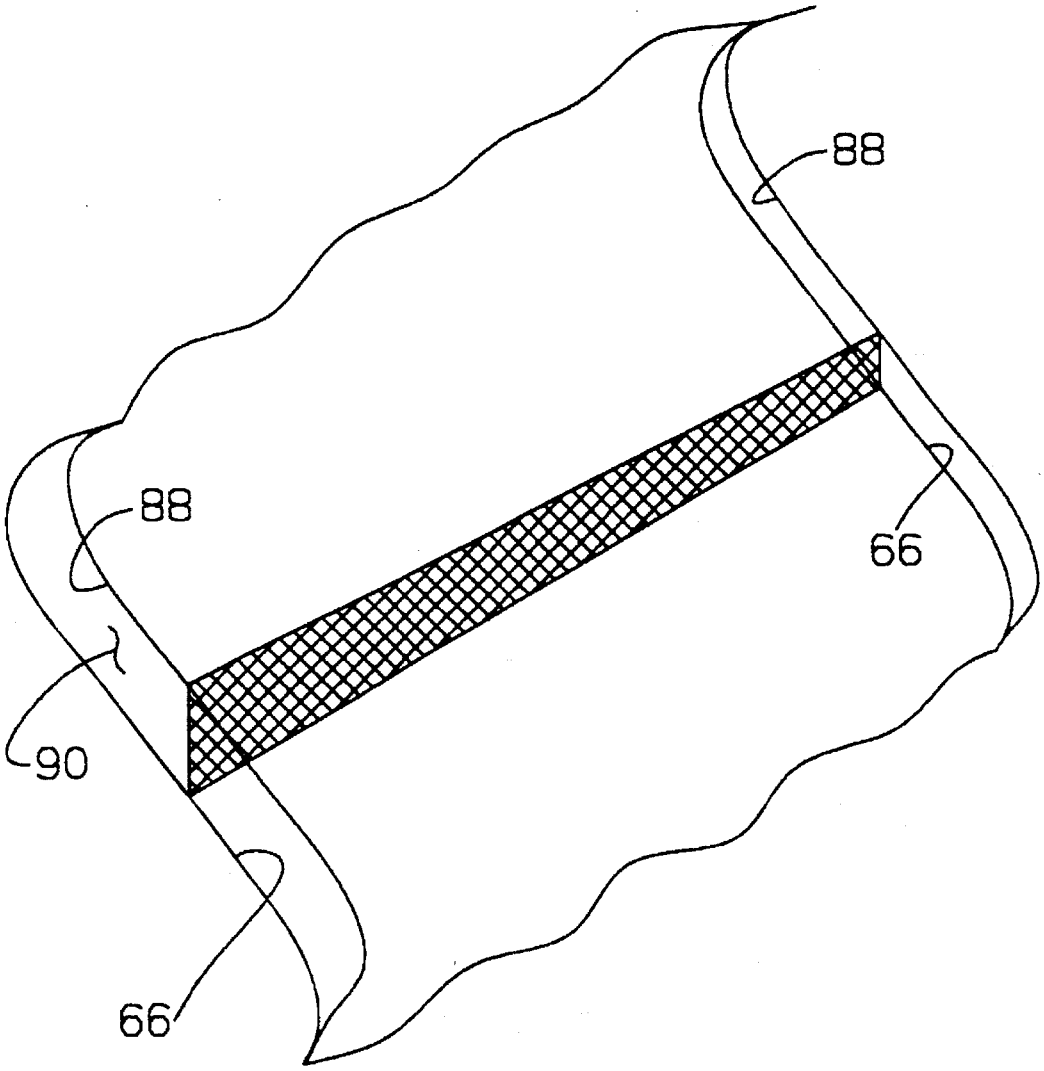
FIG. 4 is an enlarged partially sectioned view of the joint attaching a turbine blade to a turbine rotor as taken within line 4 of FIG. 3.

As further shown in FIGS. 2, 3 and 4, the gasifier turbine 29 includes a turbine rotor assembly 50 having a rotor or disc 52 therein. The disc 52 has a width being axially defined between a first side 54 and a second side 56. The rotor 50 further includes an outer periphery 58. A plurality of slots 60, only one shown, are radially positioned in the outer periphery 58 and axially extend uniformly about a center line 62 between the first side 54 and the second side 56 within the width. Each of the plurality of slots 60 has a preestablished configuration. For example, each of the slots 60, in this application, has a general fir tree configuration or cross-section and includes a plurality of contacting surfaces 64 and space surfaces 66. The configuration or cross-section of the fir tree slot 60 at the first side 54 has a preestablished cross-sectional area as designated by the outline 68 which is spaced symmetrical about the centerline 62. The second side 56 of the fir tree slot 60 has a preestablished cross-sectional area as designated by the outline 70 which is spaced symmetrical about the centerline 62. The preestablished cross-sectional area at the first side 54 is larger than the preestablished cross-sectional area at the second side 56. In other words, the configuration of each of the slots 60 through the width between the first side 54 and the second side 56 has a tapered contour on the space surfaces 66 only, as shown in the sectioned portion of FIG. 4.

The turbine rotor assembly 50 further includes a plurality of blades 74 removably positioned within corresponding ones of the plurality of slots 60. Each of the plurality of blades 74 includes a root portion 76 having preestablished width being defined between a first side 78 and a second side 80. Each of the first side 78 and the second side 80 have a generally flat configuration. The cross-section of the root 76 extending the width from the first side 78 to the second side 80 has a generally fir tree configuration 82. The fir tree configuration 82 is of a conventional design, is symmetrical about the centerline 62 at each of the first side 78 and the second side 80, has a constant cross-section from the first side 78 to the second side 80, and includes a plurality of projections 84 having a plurality of contacting surfaces 86 and a plurality of space surfaces 88 defined thereon. In the assembled position, the turbine assembly 60 includes a space or cavity 90 interposed the slot 60 in the disc 52 and the root 76 of the blade 74. Due to the construction of the slot 60 and the root portion 76 of the blade 74, the cavity 90 has a larger cross-sectional area near the first side 54 of the slot 60 than near the second side 56 of the slot 60. Thus, the cavity 90 has a generally tapered conical contour or shape. The cavity 90 is generally formed between the space surfaces 88 on the fir tree configuration 82 of the root portion 76 of the blades 74 and the space surfaces 66 of the slots 60. The cavity 90 is tapered (axially converging from the first side 54 of the disc toward the second side 56 of the disc) between the disc 52 and the blade root 76.

As more clearly shown in FIG. 1, the cooling air delivery system has a means 92 for providing a fluid flow path 94 interconnecting the compressor discharge plenum 22 with the turbine section 14. During operation, a fluid flow, designated by the arrow 96, is available in the fluid flow path 94. In this application, the means 92 for providing a fluid flow path 94 includes a plurality of internal passages 100 within the engine 10 through which the flow of cooling fluid 96 is directed therethrough. For example, a portion of the internal passages 100 are intermediate the bearing housing 46 and the combustion chamber support 33. The combustion chamber 32 is radially disposed in spaced relationship within the plenum 22 and has clearance therebetween for the flow of cooling fluid to pass therethrough. The flow path 94 for the flow of cooling fluid 96 further includes a plurality of passages 104 in the varied masses 40. The plurality of passages 104 interconnect the internal passages 100 with the cavity 90 interposed the turbine disc 52 and the root 76 of the blades 74.

Figure 5:
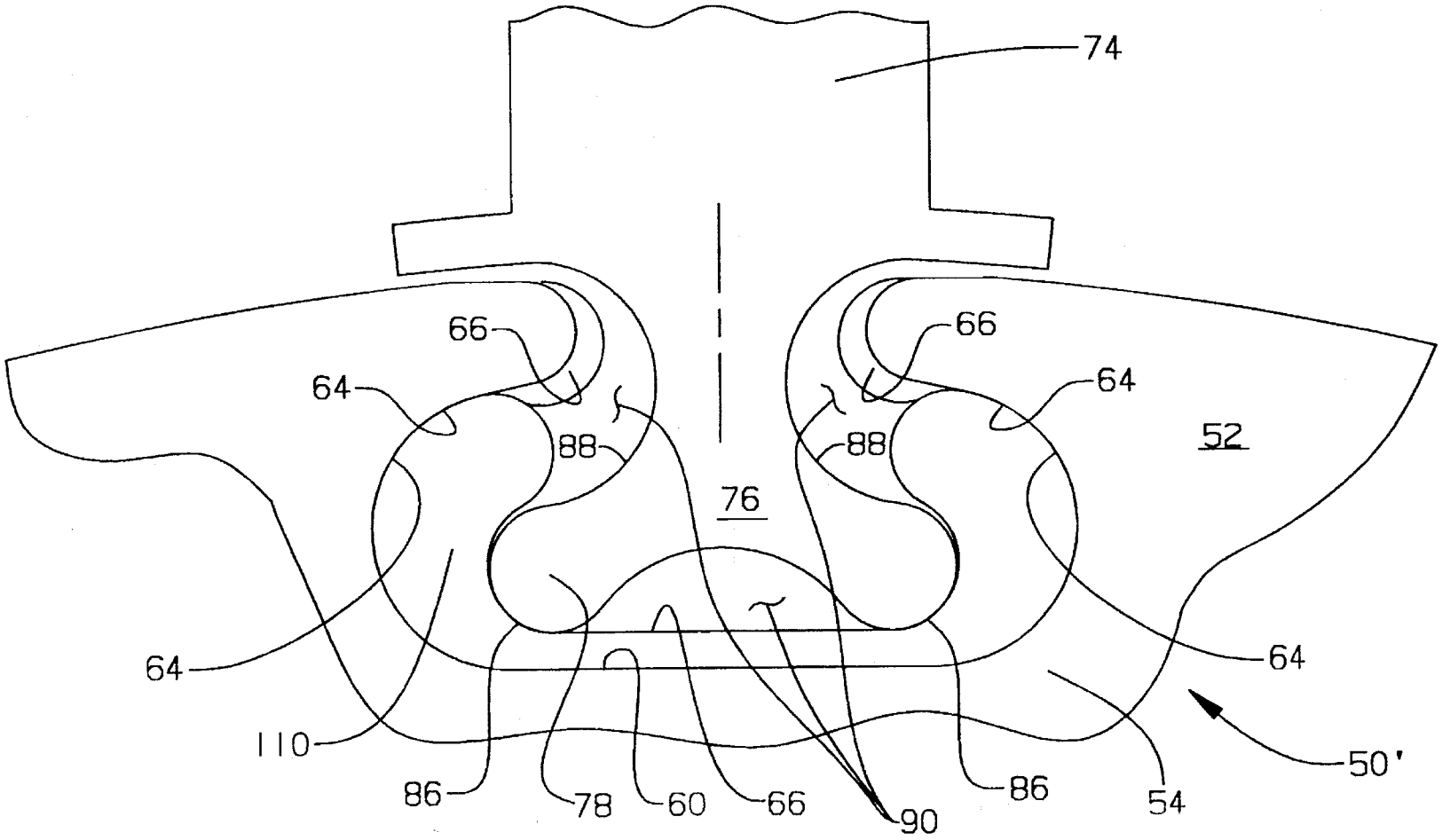
FIG. 5 is an enlarged partially sectioned view of an alternate slot and root configuration.

An alternative turbine rotor assembly 50' is shown in FIG. 5. The disc 52 includes a plurality of slots 60 having a generally bell-mouth configuration and each root 76 of the plurality of turbine blades 74 has a dogbone configuration. As a further alternative, a bearing 110 has been interposed the disc 52 and the individual blade 74. As discussed earlier, the relationship between each of the slots 60 and the blade 74 and/or the bearing 110 form the cavity 90 interposed each of the slots 60 in the disc 52 and the root portion 76 of the blades 74. Again, due to the construction of the slot 60 and the root portion 76 of the blade 74, the cavity 90 has a larger cross-sectional area near the first side 54 of the slot 60 than near the second side 56 of the slot 60. At least a portion of the cavity 90 is tapered (axially converging from the first side 54 of the disc toward the second side 56 of the disc) between the disc 52 and the blade root 76.

Figure 6:
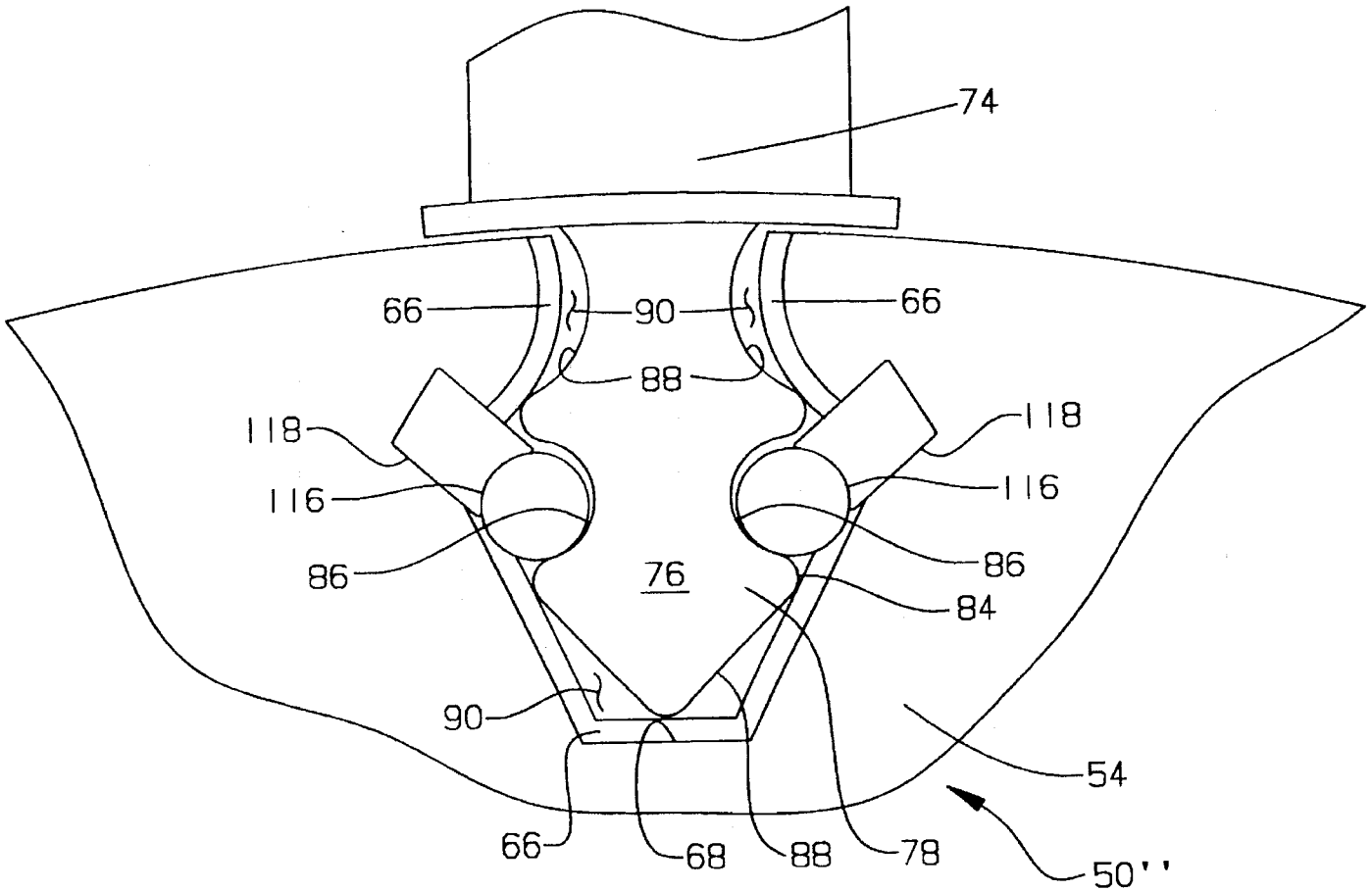
FIG. 6 is an enlarged partially sectioned view of an alternate slot and root configuration.

Another alternative rotor assembly 50" is shown in FIG. 6. The disc 52 includes a plurality of slots 60 having a generally blunt-arrow configuration and each root 76 of the plurality of turbine blades 74 has a generally rounded fir tree configuration. As a further alternative, a cylindrical bearing 116 having a guide member 118 is interposed the disc 52 and the individual blade 74. As discussed earlier, the relationship between each of the slots 60 and the blade 74 form the cavity 90 interposed each of the slots 60 in the disc 52 and the root portion 76 of the blades 74. Again, due to the construction of the slot 60 and the root portion 76 of the blade 74, the cavity 90 has a larger cross-sectional area near the first side 54 of the slot 60 than near the second side 56 of the slot 60. Thus, the cavity 90 has a generally tapered contour or shape. The cavity 90 is generally formed between the space surfaces 88 on the root portion 76 of the blades 74 and the space surfaces 66 of the slots 60. The cavity 90 is tapered (axially converging from the first side 54 of the disc toward the second side 56 of the disc) between the disc 52 and the blade root 76.

Any configuration of the slot 60 and the combined configuration of the root portion 76 of the blade 74 can be used to form the cavity 90 having a generally tapered cross-sectional area.

Industrial Applicability

In operation, the means 92 for providing a fluid flow path 94 for the cooling fluid or air from the compressor section 20 as used in the delivery system 12 increases the efficiency and power of the gas turbine engine 10 while increasing the longevity of the components used within the gas turbine engine 10. The following operation will be directed to the first stage turbine 38; however, the cooling operation could be applied to the remainder of the turbine stages in a similar manner. A portion of the compressed air from the compressor section 20 is bled therefrom forming the flow of cooling fluid designated by the arrows 96 used to cool the turbine assembly 38. The air exits from the compressor section 20 into the compressor discharge plenum 22 and enters into a portion of the fluid flow path 94. Thus, the flow of cooling air designated by the arrows 96 enters into the internal passages 100 and into the plurality of passages 104 in the varied masses 40. The flow of cooling air 96 continues from the plurality of passages 104 into the cavity 90 interposed the turbine disc 52 and the root portion 76 of the blades 74.

During operation, the plurality of contacting surfaces 86 on the fir tree configuration 82 of the root portion 76 and of the blades 74 are in contact with the corresponding one of the plurality of the contacting surfaces 64 of the slots 60. Thus, the cavity 90 formed generally between the space surfaces 88 on the fir tree configuration 82 of the root portion 76 of the blades 74 and the space surfaces 66 of the slots 60 allow cooling fluid or air 96 to pass therethrough. The tapered (axially converging) cavity 90 between the disc 52 and the blade root 76 maintains an axially controlled heat dissipation rate at the disc/blade interface along the entire length of the axial cooling cavity 90.

Thus, the cooling air delivery system 12 prevents ingestion of hot power gases into the internal components of the gas turbine engine 10 and provides a controlled heat dissipation rate between the disc 52 and the blades 74 along the entire length of the axial cooling cavity 90. Furthermore, the primary advantages of the improved turbine cooling system provide a more efficient use of the cooling air bled from the compressor section 20, increases the component life and efficiency of the engine and insure that the main portion of the compressed air remains for engine main gas stream.

Other aspects, objects and advantages of this invention can be obtained from a study of the drawings, the disclosure and the appended claims.

We claim:

1. A cooling air delivery system for cooling components of a gas turbine engine having a turbine assembly, a compressor section and a compressor discharge plenum fluidly connecting the air delivery system to the compressor section comprising:

means for providing a fluid flow path between the compressor section and the turbine assembly, said fluid flow path interconnecting the compressor discharge plenum with the engine components to be cooled and having a cooling fluid flowing therethrough when the compressor section is in operation;

said turbine assembly including a disc having a first side, a second side, an outer periphery having a plurality of slots therein extending axially between the first side and the second side, and a plurality of blades having a root portion positioned in corresponding ones of the plurality of slots; and said relationship of the slot to the root portion forming a cavity having a generally decreasing cross-section from the first side of the disc to the second side of the disc.

2. The cooling air delivery system of claim 1 wherein said generally decreasing cross-section of the cavity has a generally tapered configuration.

3. The cooling air delivery system of claim 2 wherein said generally decreasing cross-section decreases at a rate which is proportionate to an axial length between the first side and the second side.

4. The cooling air delivery system of claim 1 wherein each of said plurality of slots has a portion thereof having a generally tapered cross-section.

5. The cooling air delivery system of claim 4 wherein said root portion of each of said plurality of blades has a generally constant cross-section extending from the first side to the second side.

6. A turbine assembly including a disc having a first side, a second side, an outer periphery having a plurality of slots therein extending axially between the first side and the second side, and a plurality of blades having a root portion positioned in corresponding ones of the plurality of slots; and said relationship of the slot to the root portion forming a cavity having a generally decreasing cross-section from the first side of the disc to the second side of the disc.

7. The turbine assembly of claim 6 wherein said decreasing cross-section of the cavity has a generally tapered configuration.

8. The turbine assembly of claim 7 wherein said generally decreasing cross-section decreases at a rate which is proportionate to an axial length between the first side and the second side.

9. The turbine assembly of claim 6 wherein each of said plurality of slots has a portion thereof having a generally tapered cross-section.

10. The turbine assembly of claim 9 wherein said root portion of each of said plurality of blades has a generally constant cross-section extending from the first side to the second side.

* * * * *